US007963635B2

(12) United States Patent
Oikawa et al.

(10) Patent No.: US 7,963,635 B2
(45) Date of Patent: Jun. 21, 2011

(54) INKJET PRINT HEAD

(75) Inventors: Masaki Oikawa, Inagi (JP); Keiji Tomizawa, Yokohama (JP); Mikiya Umeyama, Tokyo (JP); Toru Yamane, Yokohama (JP); Chiaki Muraoka, Kawaguchi (JP); Yuichiro Akama, Kawasaki (JP); Tomotsugu Kuroda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 12/328,404

(22) Filed: Dec. 4, 2008

(65) Prior Publication Data

US 2009/0147056 A1 Jun. 11, 2009

(30) Foreign Application Priority Data

Dec. 11, 2007 (JP) ..... 2007-320143

(51) Int. Cl.
*B41J 2/05* (2006.01)

(52) U.S. Cl. ..... 347/61; 347/65

(58) Field of Classification Search ..... 347/61, 347/65

See application file for complete search history.

(56) References Cited

U.S. PATENT DOCUMENTS

| | | | | |
|---|---|---|---|---|
| 5,208,605 | A | 5/1993 | Drake | |
| 6,652,079 | B2 | 11/2003 | Tsuchii et al. | |
| 6,830,317 | B2 | 12/2004 | Tsuchii et al. | |
| 6,971,736 | B2 | 12/2005 | Tomizawa et al. | |
| 6,984,025 | B2 | 1/2006 | Kaneko et al. | |
| 7,108,352 | B2 | 9/2006 | Muraoka | |
| 7,267,429 | B2 | 9/2007 | Furukawa | |
| 2002/0063756 | A1 * | 5/2002 | Tsuchii et al. | 347/65 |
| 2009/0058949 | A1 | 3/2009 | Tomizawa et al. | |

FOREIGN PATENT DOCUMENTS

| | | | |
|---|---|---|---|
| CN | 1485206 | A | 3/2004 |
| EP | 1 016 525 | | 7/2000 |
| EP | 1 270 229 | | 1/2003 |
| JP | 4-10941 | | 1/1992 |
| JP | 5-201003 | A | 8/1993 |
| JP | 2003-311964 | | 11/2003 |
| JP | 2005-1379 | | 1/2005 |
| KR | 2003-0084654 | A | 11/2003 |
| KR | 2004-0005693 | A | 1/2004 |
| RU | 2005 141 543 | A | 5/2006 |
| WO | 2007-129764 | A1 | 11/2007 |

OTHER PUBLICATIONS

Office Action and translation in KR Patent Appln. No. 10-2008-0125307, dated Jan. 5, 2011.

* cited by examiner

*Primary Examiner* — Kevin S Wood

(74) *Attorney, Agent, or Firm* — Fitzpatrick, Cella, Harper & Scinto

(57) ABSTRACT

The landing precision of ink drops is improved to improve the image quality and increase the printing speed. An inkjet print head ejects ink supplied from an ink supply port from a plurality of ejection ports respectively connecting to ink paths having different flow resistances by using energy generated by a plurality of electrothermal transducer elements respectively corresponding to the plurality of the ejection ports, wherein each of the plurality of the ejection ports connected to the ink paths having a low ink flow resistance is arranged so that the center of each of the plurality of the ejection ports is positioned farther away from the ink supply port to the center of the corresponding electrothermal transducer element than each of the plurality of the ejection ports connected to the ink paths having a high ink flow resistance.

6 Claims, 10 Drawing Sheets

INKJET PRINT HEAD

BACKGROUND OF THE INVENTION

1. Field of the Invention

This invention relates to an inkjet print head, and more particularly, to an inkjet print head having ejection ports for ejecting different ink drops.

2. Description of the Related Art

For halftone reproduction, some inkjet printing methods employ a dot density control method for controlling the number of print dots per unit area by the print dot of a uniform size. In a known printing method of them, ejection ports for ejecting ink drops of different sizes are provided in order to eject the small ink drops to form print dots for a part of an image ranging from a light tone to a half tone, and to eject the lager ink drops to form print dots for a part of the image ranging from a half tone to a dark tone (see Japanese Patent Laid-open No. H04-10941 (1992), for example).

In a known printing apparatus in which ejection ports are designed to eject ink drops of different sizes as described above, the ejection ports are arranged such that ink paths are changed in cross-sectional area and/or ink-flow resistance for large fluid drops and small fluid drops (see Japanese Patent Laid-open No. 2003-311964, for example).

On the other hand, if the size of the ink drop is more reduced for an improvement in image quality, a desired amount of ink ejection may not be applied because of the small ink drops. To avoid this, the resolution of a row of ejection ports can be increased with a reduction in size of the ink drop. In this case, however, the ratio of the size of a heater to the resolution of the row of the ejection ports significantly increases. This makes it difficult to route heater wiring, which in turn may make it impossible to arrange heaters in line. Also, the ink paths for supplying ink may not be arranged in line.

Therefore, the zigzag arrangement of the heaters as shown in FIG. 10 is generally known. Also, the print head with ejection ports for ejecting large and small ink drops which are arranged in a zigzag relationship is known (see Japanese Patent Laid-Open 2005-1379, for example).

For printing by the inkjet printing method, the ink in the ejection port is rapidly heated by the heater, to create a bubble. The expansion of the bubble forces the ink to drop out of the ejection port. In this printing, sub droplets (satellites) following the main drop at the time of drop formation may cause image degradation. Specifically, depending on the directionality of an ink tail formed at the time of drop formation, the flying direction of the satellites is changed. As a result, the satellites and the main drop fly in different directions from each other. For example, when the ink paths for ejecting small ink drops differ in length by arranging the ejection ports in a zigzag relationship, the flying pattern of the satellites may be varied in accordance with the ink-path length. For this reason, in the print head with the zigzag arrangement of the ejection ports, the landing of the satellites may affect a printed image. For example, it may cause an increase in graininess of the printed image and/or inconsistencies in density or a streak on a scan boundary because of a difference in dot density.

For the purpose of limiting the effect of the deviation of the landing position on the print image, the printing speed can be reduced by reducing the speed of the carriage moving in the main scan direction or by increasing the number of multi-paths, in order to lower the effect of the satellites. However, this method cannot offer an improvement in printing speed.

In addition, as the size of a droplet is increasingly reduced, the satellite droplets may disadvantageously cause occurrence of stains in the inside of the printing apparatus such as a printer, due to misting.

SUMMARY OF THE INVENTION

The present invention is made in view of the foregoing and it is an object of the present invention to improve the straight forward property of an ink drop flying in an ejection direction even when the amount of the ink drop is very small, in order to provide an inkjet print head which is capable of improving the landing precision of ink drops for an improvement in image quality of a printed image and an increase of printing speeds.

To attain this object, in an inkjet print head of the present invention, the inkjet print head ejects ink supplied from an ink supply port from a plurality of ejection ports respectively connecting to ink paths having different flow resistances by using energy generated by a plurality of electrothermal transducer elements respectively corresponding to the plurality of the ejection ports. Each of the plurality of the ejection ports connected to the ink paths having a low ink flow resistance is arranged so that the center of each of the plurality of the ejection ports is positioned farther away from the ink supply port to the center of the corresponding electrothermal transducer element than each of the plurality of the ejection ports connected to the ink paths having a high ink flow resistance.

According to the present invention, the structure of the inkjet print head allows an ink drop tail to be inhibited from skewing. In consequence, the straight forward property of an ink drop flying in an ejection direction is improved to allow a high-quality image to be printed at high speeds.

Further features of the present invention will become apparent from the following description of exemplary embodiments (with reference to the attached drawings).

DESCRIPTION OF THE EMBODIMENTS

Exemplary embodiments in the present invention will be described below in detail with reference to the accompanying drawings.

First Embodiment

Figure 1:
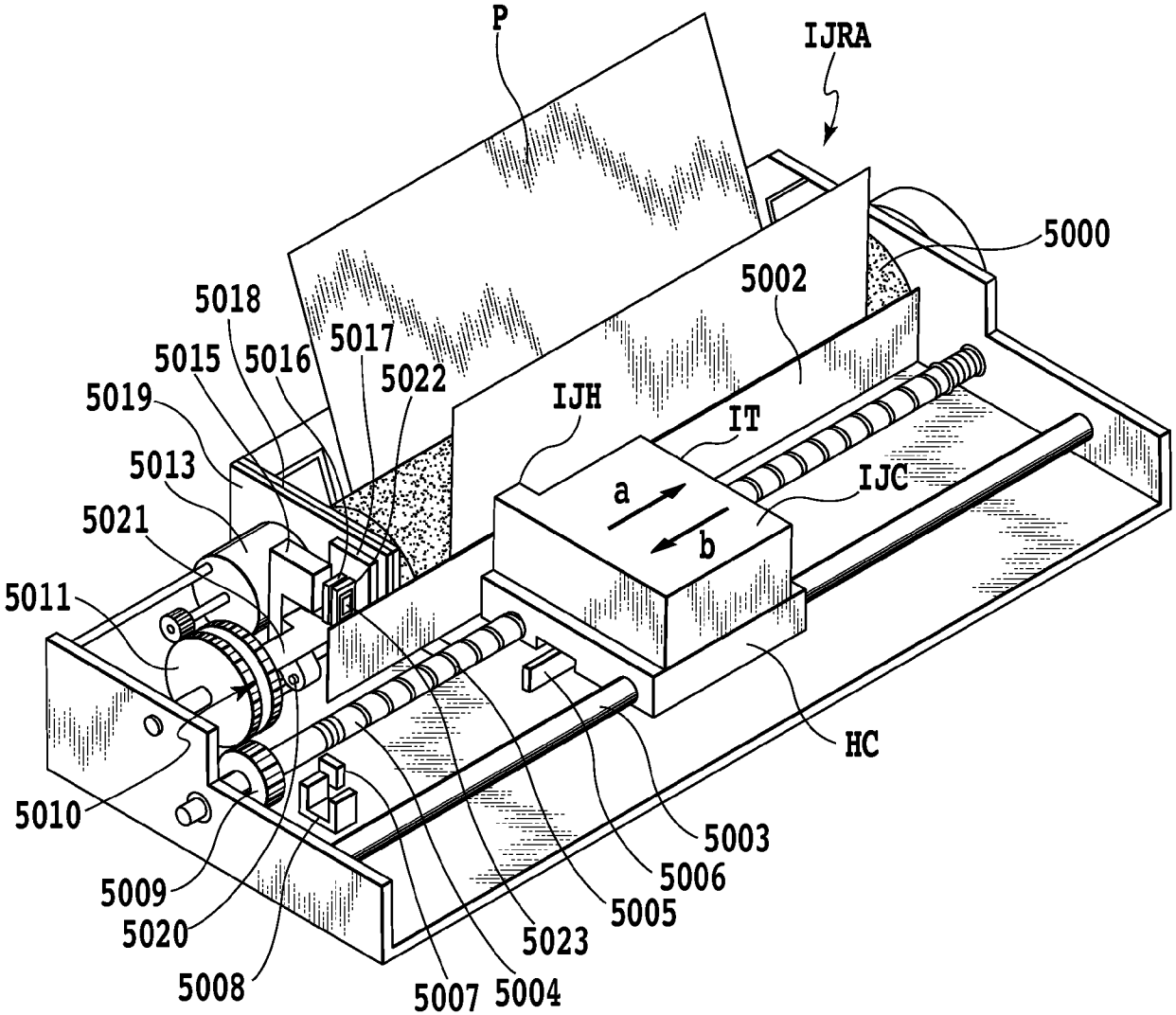
FIG. 1 is a perspective outline view illustrating the structure of an inkjet printing apparatus according to a first embodiment of the present invention.

FIG. 1 is a perspective outline view illustrating the structure of an inkjet printing apparatus IJRA according to a first embodiment of the present invention. In FIG. 1, a carriage HC has mounted on it an integral-type inkjet cartridge IJC having a print head IJH and an ink tank IT built therein. The carriage HC is supported by a guide rail 5003 to reciprocate on a print medium in the directions of the arrows a and b for printing operation. A support member 5016 supports a cap member 5022 capping the front face of the print head IJH. A suction device 5015 vacuums the inside of the cap to perform the suction recovery operation on the print head through an opening 5023 formed in the cap.

Figure 2:
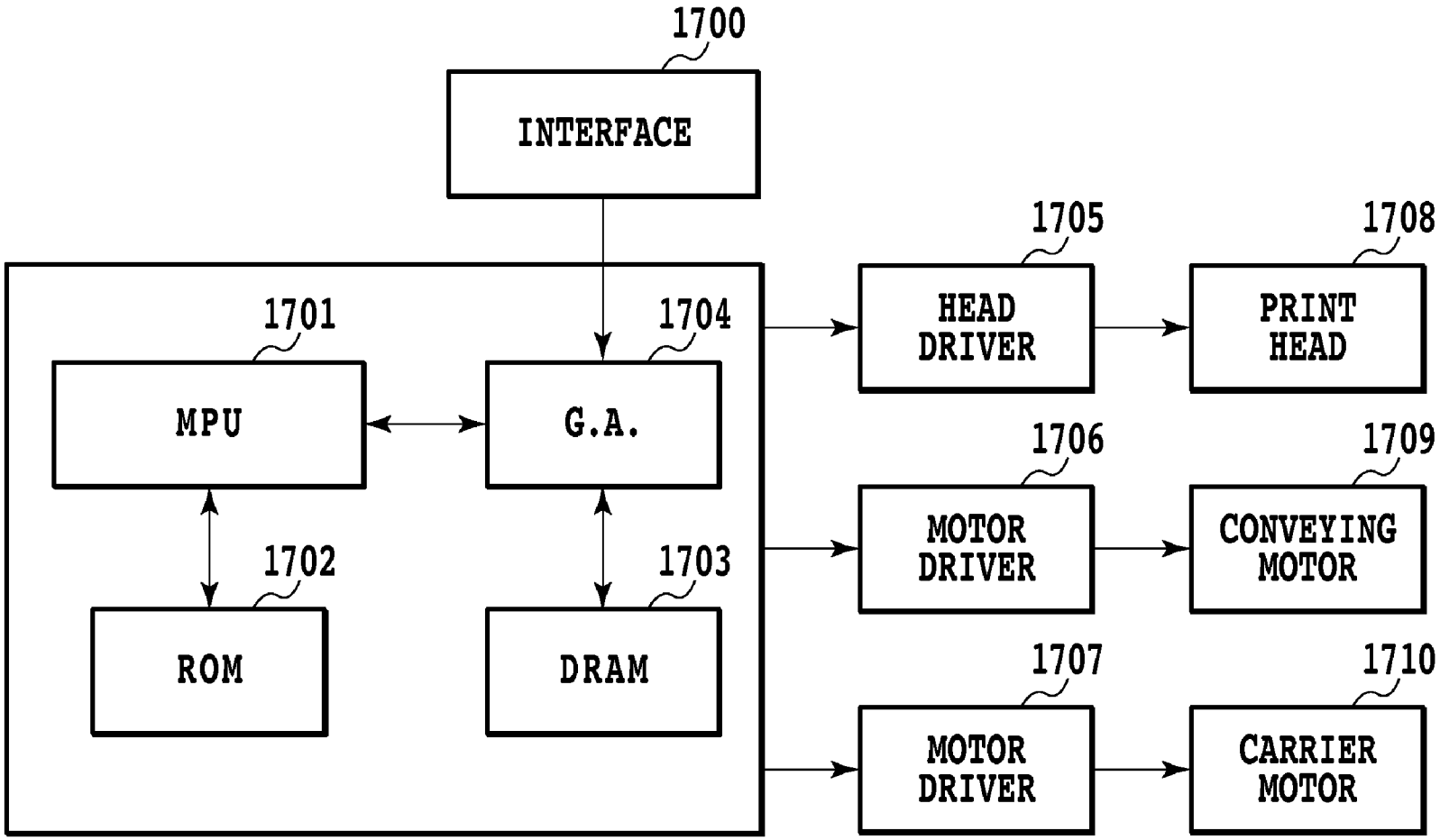
FIG. 2 is a block diagram illustrating the configuration of a control circuit of the inkjet printing apparatus according to the first embodiment of the present invention.

FIG. 2 is a block diagram illustrating the configuration of a control circuit of the inkjet printing apparatus IJRA. Upon the reception of a print signal at an interface 1700, the print signal is translated into print data for printing operation between a gate array 1704 and an MPU 1701. Then motor drivers 1706, 1707 are driven and the print head IJH is driven based on the print data supplied to a head driver 1705 for printing operation.

Next, the inkjet print head IJH in the first embodiment will be described. The inkjet print head of the first embodiment is equipped with means for generating thermal energy as energy used for ejection of liquid ink, and employs a technique of using the generated thermal energy to effect a change in ink state. The use of this technique leads to the achievement of high density and high definition of a printed image, printed letters and/or the like. The first embodiment employs an electrothermal transducer element as the means for generating thermal energy. The electrothermal transducer element heats the ink to cause film boiling, whereupon bubble growth occurs. Then, the ink is ejected by use of the pressure of the expanding bubble.

Figure 3:
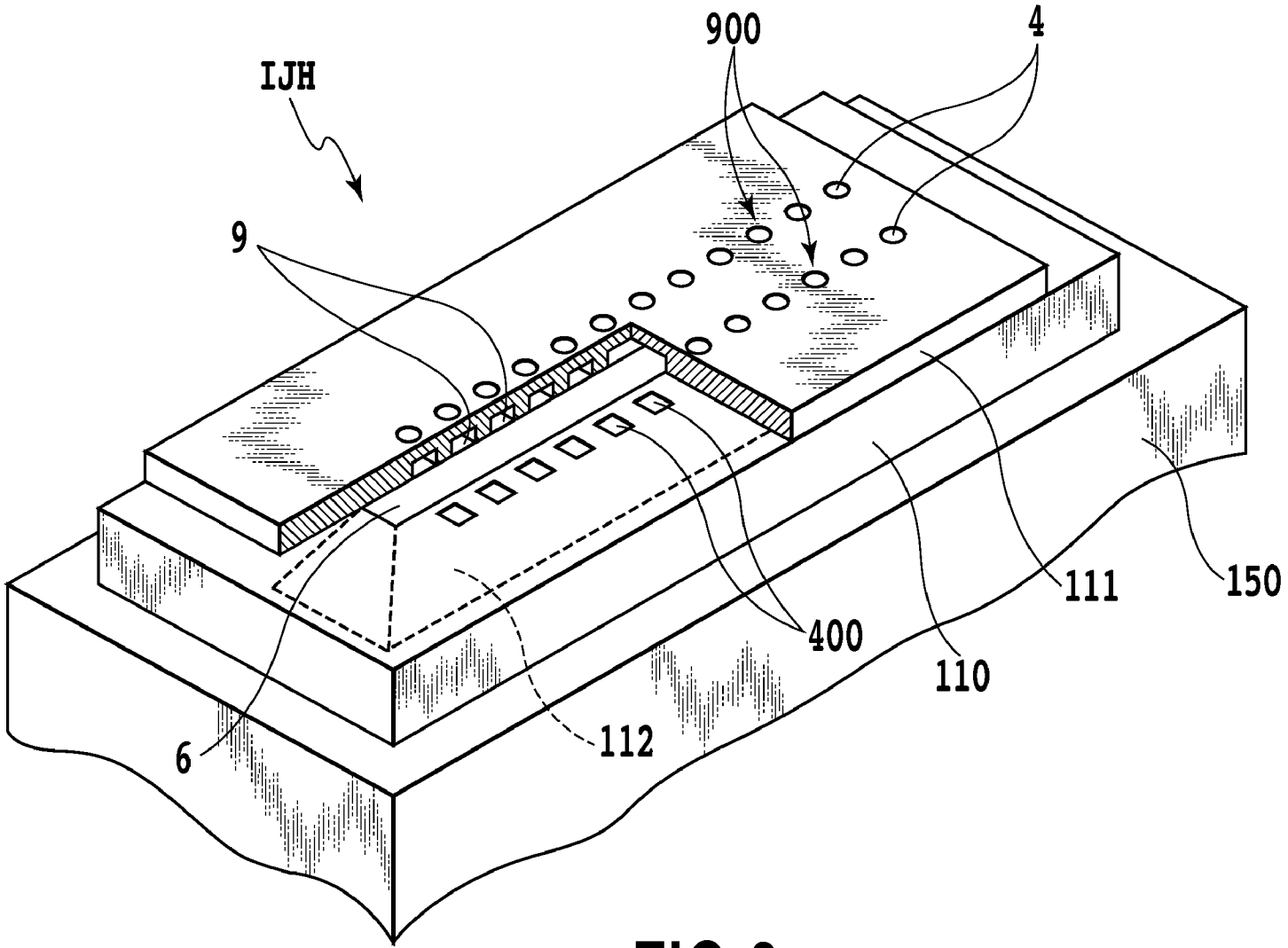
FIG. 3 is a perspective cutaway view of an inkjet print head according to the first embodiment of the present invention.

FIG. 3 is a perspective cutaway view of the inkjet print head of the first embodiment. The inkjet print head is provided with an element substrate 110 having mounted thereon a plurality of heaters 400 which are electrothermal transducer elements, and a path forming member 111 laminated on and joined to the principal surface of the element substrate 110 to form a plurality of ink paths. The element substrate 110 may be formed of, for example, glass, ceramics, resin, metal or the like, and is typically formed of Si. On the principal surface of the element substrate 110 the heaters 400 and electrodes (not shown) for applying voltage to the heaters 400 are provided for each ink path, and also wiring (not shown) connected to the electrodes is provided in a predetermined wiring pattern. In addition, on the principal surface of the element substrate 110, an insulating film (not shown) for improving the dissipation of accumulated heat is provided so as to cover the heater 400, and in turn the insulating film is covered with a protective film (not shown) provided for protection from cavitation occurring when the bubble collapses.

As shown in FIG. 3, the path forming member 111 has a plurality of ink paths 9 through which ink flows, an ink supply port (supply chamber) 6 for supplying the ink to the ink paths 9, and a plurality of ejection ports 4 from which the ink is ejected. The ejection ports 4 are formed in the respective positions corresponding to the heaters 400 provided on the element substrate 110.

The inkjet print head has a plurality of ejection ports 4 and a plurality of heaters 400 on the element substrate. The inkjet print head is provided with a first ejection-port row of the ejection ports 4 which are arranged such that the longitudinal axes of the respective ejection ports 4 are parallel to each other, and a second ejection-port row of the ejection ports 4 which are arranged such that the longitudinal axes of the respective ejection ports 4 are parallel to each other. The first ejection-port row and the second ejection-port row are placed on opposite sides of the supply chamber. In the first and second ejection-port rows, the adjacent ejection ports 4 are arranged at intervals corresponding to 600-dpi pitches or 1200-dpi pitches. For the reason of dot arrangement, the ejection ports 4 in the second ejection-port row and the corresponding ejection ports 4 in the first ejection-port row are staggered apart by a pitch between adjacent ejection ports as necessary.

Next, the structure of the ejection port in the inkjet print head will be described.

In the print head of the first embodiment, in regard to the ink paths having a high flow resistance, the offset amount (i.e., the amount of distance) of each ejection port from the center of the corresponding heater is decreased. Specifically, in the process of collapse of the bubble created by the heater, the bubble collapses in an off-center position, so that the meniscus in the ejection port is retracted toward a lower resistance side. For this reason, the tail of the ink drop may skew. To avoid this, the ejection port is designed in an offset manner to suppress the tail skew.

Figure 4A:
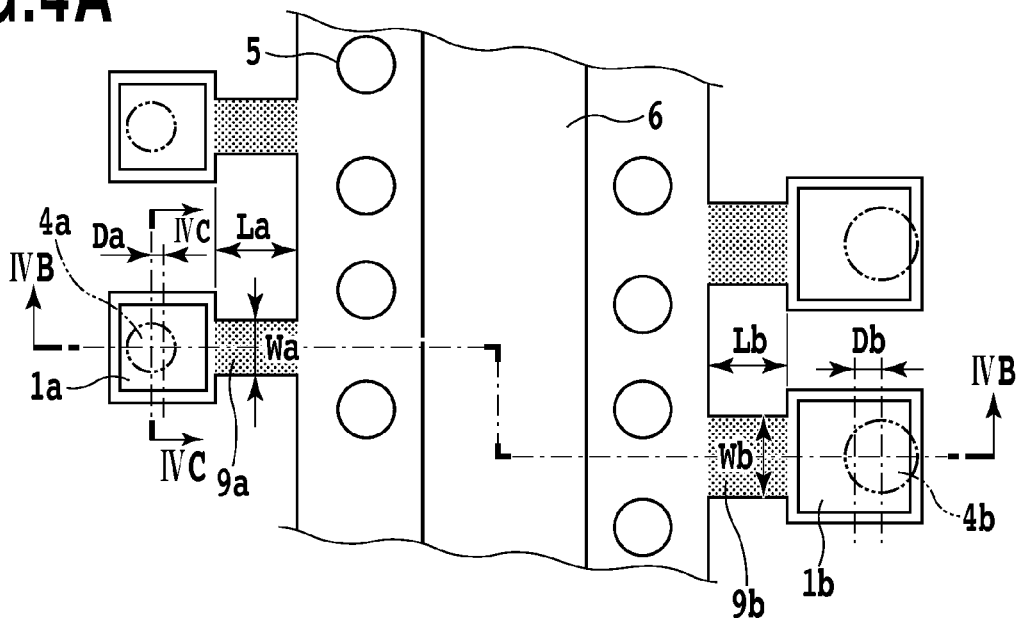
FIG. 4A to FIG. 4C are diagrams each illustrating the structure of ejection ports of the inkjet print head according to the first embodiment of the present invention.
Figure 4B:
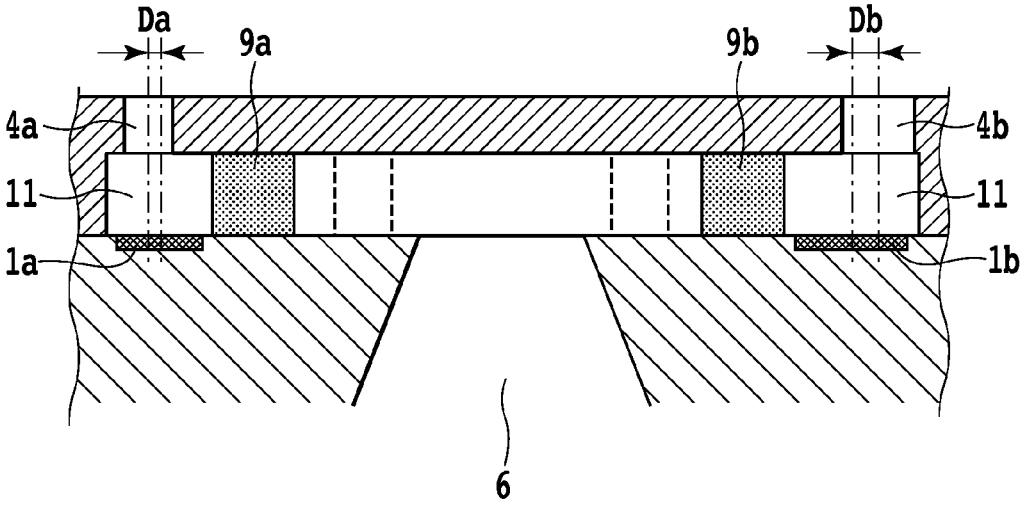
Figure 4C:
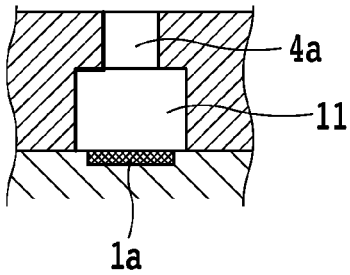

FIG. 4A to FIG. 4C are diagrams each illustrating the structure of the ejection ports of the inkjet print head according to the first embodiment. FIG. 4A is a plan view showing some of the plurality of ejection ports when viewed from the direction at right angles to a substrate of the inkjet print head. FIG. 4B is a sectional view taken along the IVB-IVB line in FIG. 4A. FIG. 4C is a sectional view taken along the IVC-IVC line in FIG. 4A.

In the print head of the first embodiment, the ejection ports connected to the ink paths having different flow resistances are arranged on the right and left sides. Each of the ink paths 9*a*, 9*b* corresponding to these ejection ports has one end linked to a pressure chamber 11 and the other end linked to the ink supply port 6 through an ejection-port filter 5. In the boundary between the pressure chamber 11 and the ink path 9 in the first embodiment, the row-direction width of the ejection port is changed. The pressure chamber begins from where the row-direction width of the ejection port is increased. The print head is structured such that the ejection direction in which an ink droplet is fired from the ejection port 4 is at right angles to the flowing direction of the ink liquid flowing in the supply path.

Each of the ejection-port pitches in the direction of the ejection-port row is 42.3 μm (600 dpi). Each of the heaters 1*a* is shaped in a 15-μm square. Each of the heaters 1*b* is shaped in a 20-μm square. The amount of offset (the amount of distance) in the direction of the ejection-port row is 21.2 μm (1200 dpi). The ejection ports 4*a*, 4*b* are respectively shaped in a ϕ8 diameter circle and a ϕ13 diameter circle, and a droplet of about 1.0 pl and a droplet of about 2.0 pl are respectively ejected from the ejection ports 4*a*, 4*b*. The ink paths 9*a*, 9*b* have lengths La, Lb of 17 μm and respectively widths Wa, Wb of 10 μm, 15 μm.

The centers of the ejection ports 4*a*, 4*b* are respectively in offset relationships with the centers of the heaters 1*a*, 1*b*, in which the ejection ports are arranged such that the lower the flow resistance, the larger the amount of offset (the amount of distance) is set.

The flow-path resistance $R_b$ can be calculated from the following equation.

$$R_b=\mu\int_O^L D(y)dy/S(y)^2$$

$$D(y)=12.0\times(0.33+1.02(c(y)/d(y)+d(y)/c(y)))$$

where $R_b$=flow resistance from the electrothermal transducer element to the common liquid chamber, L=distance from the center of the electrothermal transducer element to the common liquid chamber, y=distance from the common liquid chamber, S(y)=sectional area of the ink path in a position at distance y, D(y)=section modulus of the ink path in a position at distance y, c(y)=height of the ink path in a position at distance y, d(y)=width of the ink path in a position at distance y, and η=ink viscosity.

Regarding the amount of offset, when the flow resistance Rb of the ink path is 0.03 (P(peta=$10^{15}$)Pa·s/$m^3$) or higher and less than 0.2 (P·Pa·s/$m^3$), the amount of ejection-port offset ranges desirably from zero to 3 μm.

When the flow resistance Rb of the ink path is 0.02 (P·Pa·s/$m^3$) or higher and less than 0.06 (P·Pa·s/$m^3$), the amount of ejection-port offset ranges desirably from 3 μm to 6 μm.

In the print head of the first embodiment, the amount of offset Da of the ejection port 4*a* of the ink path 9*a* with a high flow resistance is set at 2 μm, and the amount of offset Db of the ejection port 4*b* of the ink path 9*b* with a low flow resistance is set at 5 μm. The flow resistance of the ink path 9*a* is 0.054 (P·Pa·s/$m^3$) and the flow resistance of the ink path 9*b* is 0.023 (P·Pa·s/$m^3$).

Figure 5A:
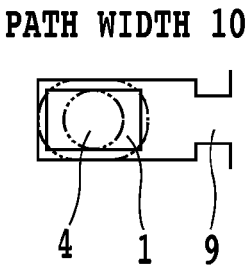
FIG. 5A and FIG. 5B are explanatory diagrams each illustrating the effect according to the first embodiment of the present invention.
Figure 5A:
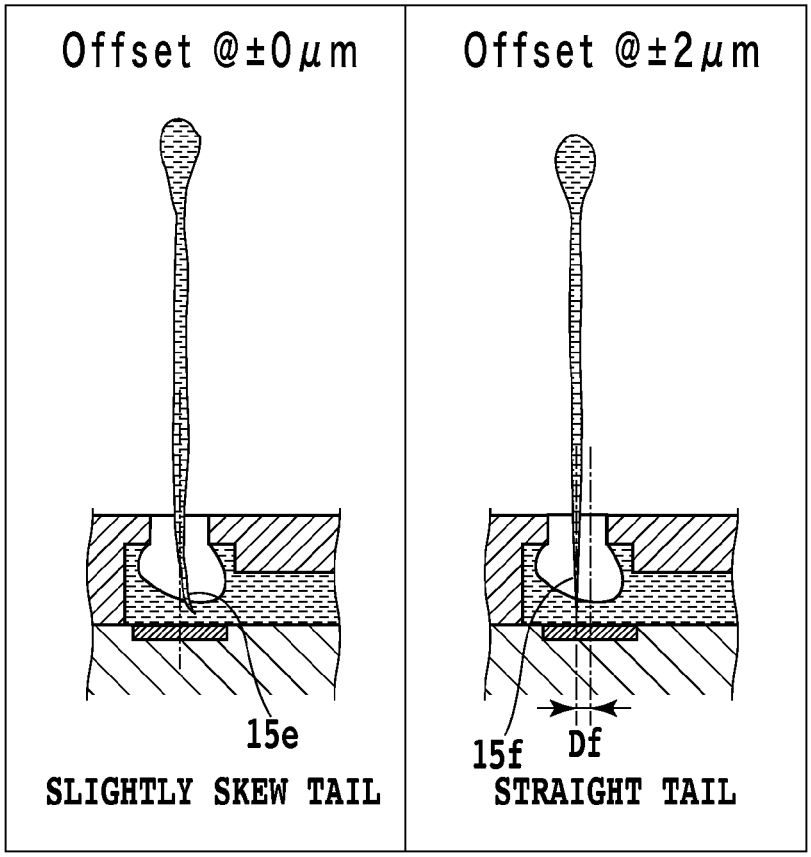
Figure 5B:
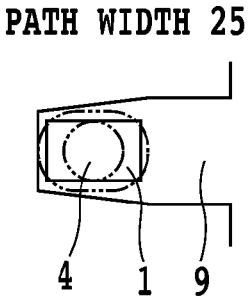
Figure 5B:
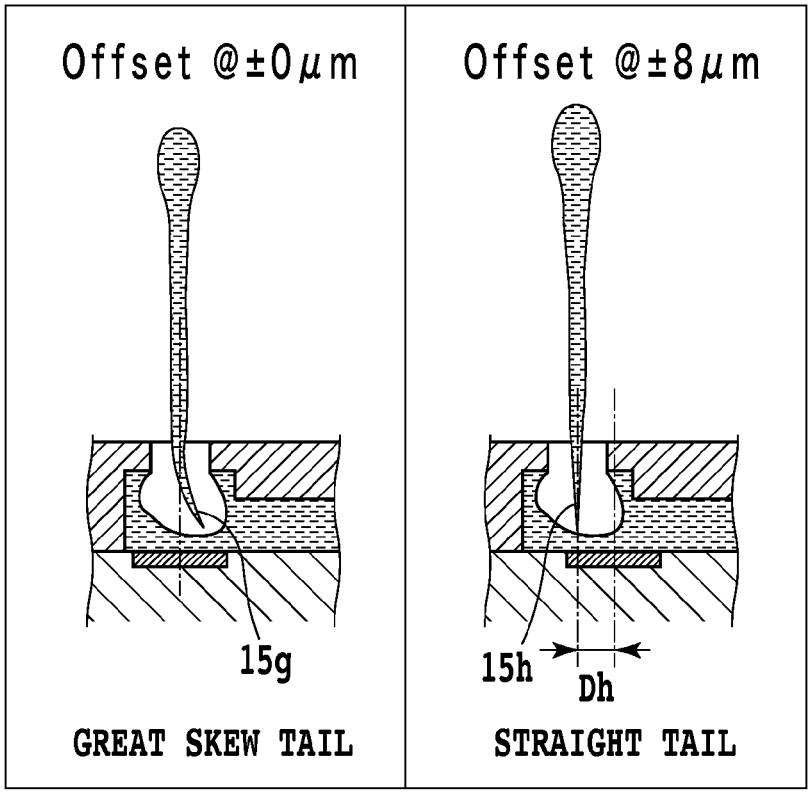
Figure 6:
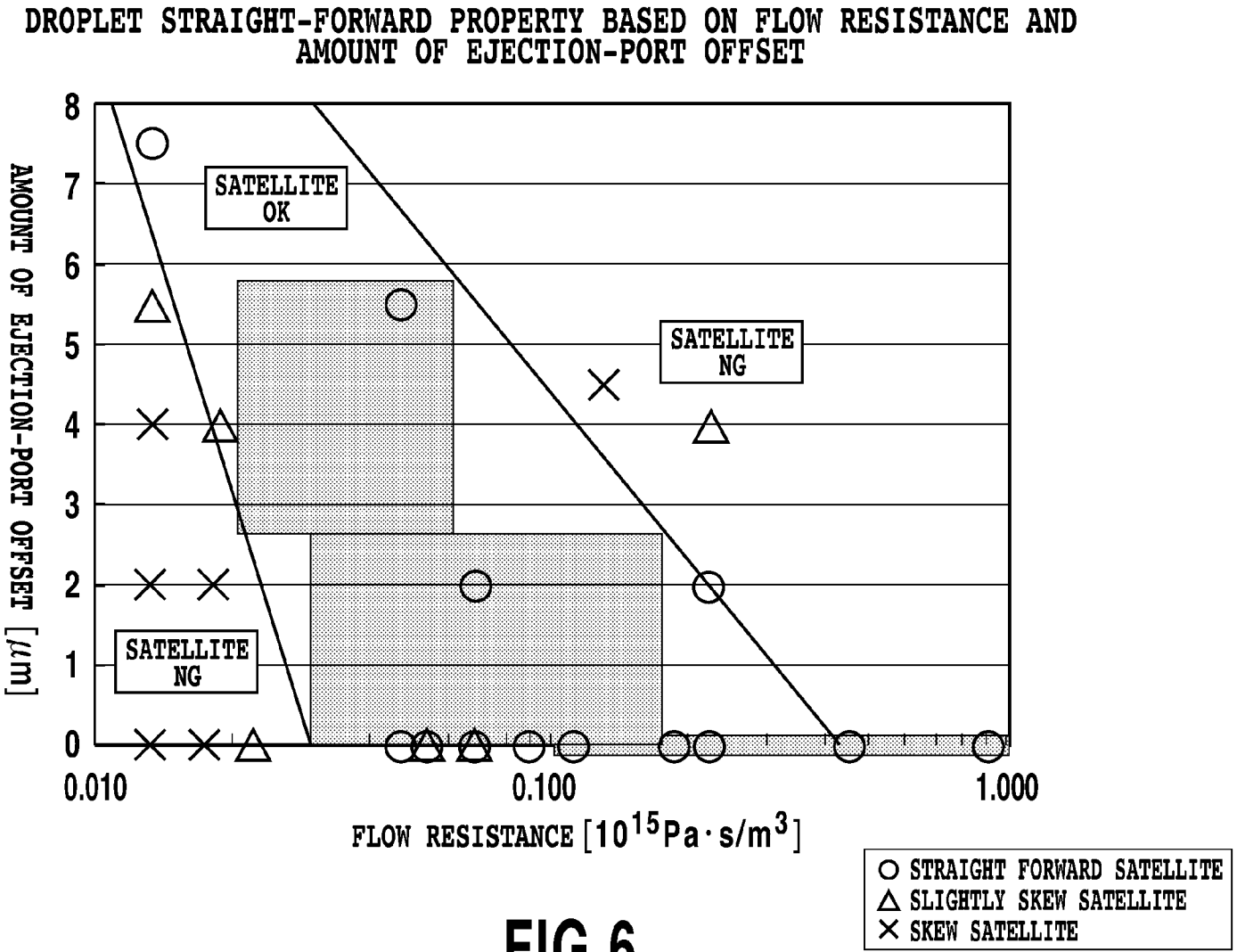
FIG. 6 is a graph for explaining the effect in the first embodiment of the present invention.

FIGS. 5A, 5B and 6 are diagrams each illustrating the effect of the first embodiment. FIG. 5A and FIG. 5B show the results of the liquid simulation performed on ink drops.

FIG. 5A and FIG. 5B are sectional views just before separation of an ejected liquid drop in the IVB-IVB cross section shown in FIG. 4A. In FIGS. 5A and 5B, the amount of ink ejected is about 2.0 pl. The path width in FIG. 5A is 10 μm, and the path width in FIG. 5B is 25 μm. In other words, the ink path shown in FIG. 5A has a higher flow resistance than that in the ink path shown in FIG. 5B.

As is seen from the left portions of FIGS. 5A and 5B, when the ejection port is not designed in an offset manner, the tail skew 15*e* in FIG. 5A showing the flow width 10 μm causing a higher flow resistance is larger than the tail skew 15*g* in FIG. 5B showing the flow width 25 μm causing a lower flow resistance.

The tail of the drop breaks up to form satellites. If the tail is skew, the satellites are ejected in a direction different from the direction in which the main drop is ejected, which affects the print image. The ejection port is designed in an offset manner for the purpose of eliminating the tail skew, which is shown in the right portions of FIGS. 5A and 5B. As is seen from FIGS. 5A and 5B, in the case of the flow width 10 μm when the flow resistance of the ink path is relatively high, the tail skew 15*f* is approximately straightened when the amount of offset is 2 μm. On the other hand, in the case of the flow width 25 μm when the flow resistance of the ink path is relatively low, the tail skew 15*h* is approximately straightened when the amount of offset is 8 μm. In this manner, the amount of offset is varied in accordance with the flow resistance of the ink path, whereby the tail skew of the ink can be suppressed and the ejection of an ink drop in a straight line can be achieved.

FIG. 6 is a graph showing the relationship among a flow resistance of an ink path, the amount of ejection-port offset, and the straight-forward property of a droplet, in which the vertical axis shows the amount of offset of the ejection port and the horizontal axis shows the flow resistance. The straight-forward property of the satellite droplets is dependent on a flow resistance of the ink path and the amount of ejection-port offset. Therefore, the proper control on the flow resistance and the amount of ejection-port offset make it possible to inhibit satellite droplets from skewing.

Second Embodiment

The inkjet print head of the first embodiment employs a linear arrangement of the ejection ports, but the present invention is not limited to such an inkjet print head.

Figure 7A:
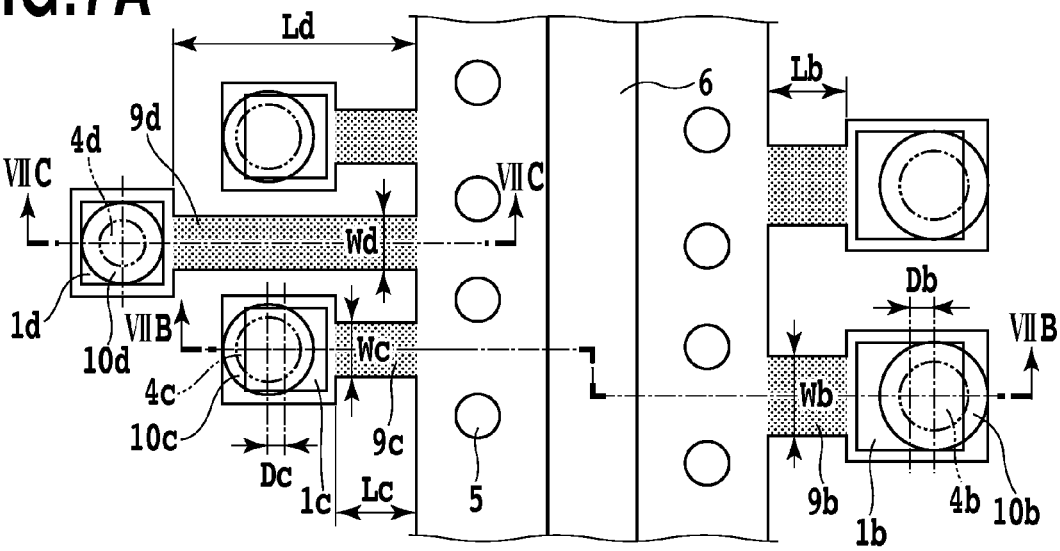
FIG. 7A to FIG. 7C are diagrams each illustrating the structure of ejection ports of an inkjet print head according to a second embodiment of the present invention.
Figure 7B:
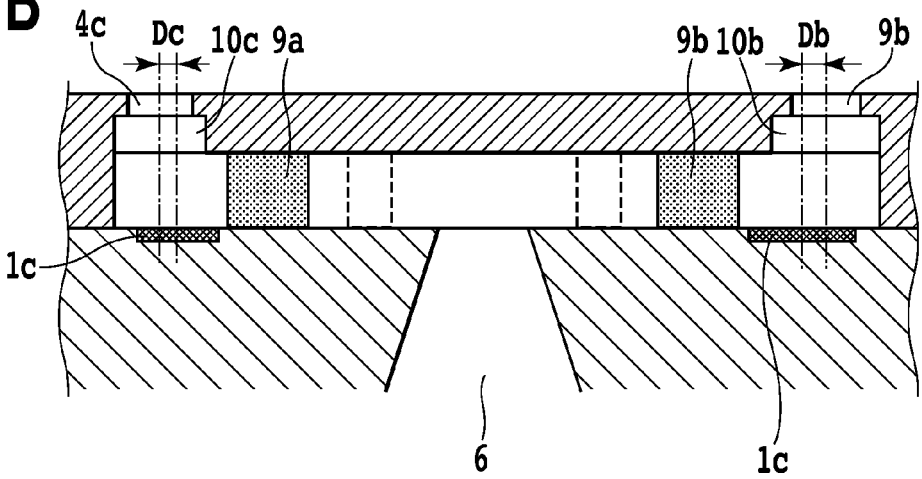
Figure 7C:
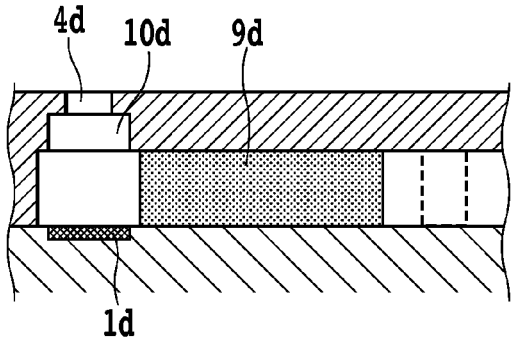

FIG. 7A to FIG. 7C are diagrams each illustrating the structure of the ejection ports of the inkjet print head according to the second embodiment. FIG. 7A is a plan view showing some of the plurality of ejection ports when viewed from the direction at right angles to a substrate of the inkjet print head. FIG. 7B is a sectional view taken along the VIIB-VIIB line in FIG. 7A. FIG. 7C is a sectional view taken along the VIIC-VIIC line in FIG. 7A.

In the print head of the second embodiment, the ejection ports connected to the ink paths having different flow resistances are arranged on the right and left sides. Each of the ink paths 9*b*, 9*c*, 9*d* corresponding to these ejection ports has one end linked to a pressure chamber 11 and the other end linked to the ink supply port 6 through an ejection-port filter 5. The ejection ports 4*c* and 4*d* are arranged in a zigzag relationship.

Each of the ejection-port pitches in the direction of the ejection-port row for the ink paths 9*b* is 42.3 μm (600 dpi), and each of ones for the ink paths 9*c* and 9*d* is 21.3 μm (1200 dpi). Each of the heaters 1*c* and 1*d* is shaped in a 15-μm square. Each of the heaters 1*b* is shaped in a 20-μm square. The ejection ports 4*b*, 4*c*, 4*d* are respectively shaped in a ϕ13 diameter circle, a ϕ11 diameter circle and a ϕ8 diameter circle, and a droplet of about 2.0 pl, a droplet of about 1.5 pl and a droplet of about 1.0 pl are respectively ejected from the ejection ports 4*b*, 4*c*, 4*d*. Each of the ejection ports 4*b*, 4*c*, 4*d* has an ejecting portion of a double stage structure. Because of this structure, a print head is reduced in flow resistance of the ejecting portion in the ejection direction to improve the ejection efficiency. The ink path 9*b* has a 17-μm length Lb and a 15-μm width Wb. The ink path 9*c* has a 17-μm length Lc and a 10-μm width Wc. The ink path 9*d* has a 65-μm length Ld and a 10-μm width Wd The centers of the ejection ports 4*b*, 4*c* are respectively in offset relationships with the centers of the corresponding heaters. On the other hand, the ejection port 4*d* is not structured in an offset manner, because the flow resistance of the ink path 9*d* is 0.21 (P·Pa·s/$m^3$) which exceeds 0.1 (P·Pa·s/$m^3$). The amount of offset Dc (the amount of distance) relating to the ink path 9*b* is 5 μm, and the amount of offset Db relating to the ink path 9*c* is 2 μm. The flow resistance of the ink path 9*b* is calculated to be 0.023 (P·Pa·s/$m^3$), and the flow resistance of the ink path 9*c* is calculated to be 0.054 (P·Pa·s/$m^3$).

Third Embodiment

A third embodiment relates to an inkjet print head which differs in ejecting portions from that in the second embodiment.

Figure 8A:
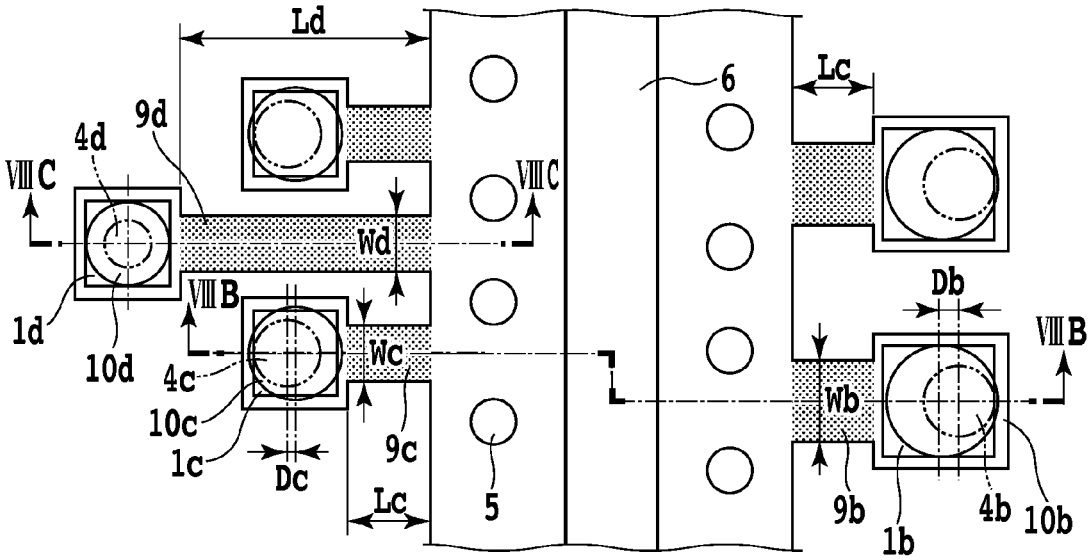
FIG. 8A to FIG. 8C are diagrams each illustrating the structure of ejection ports of an inkjet print head according to a third embodiment of the present invention.
Figure 8B:
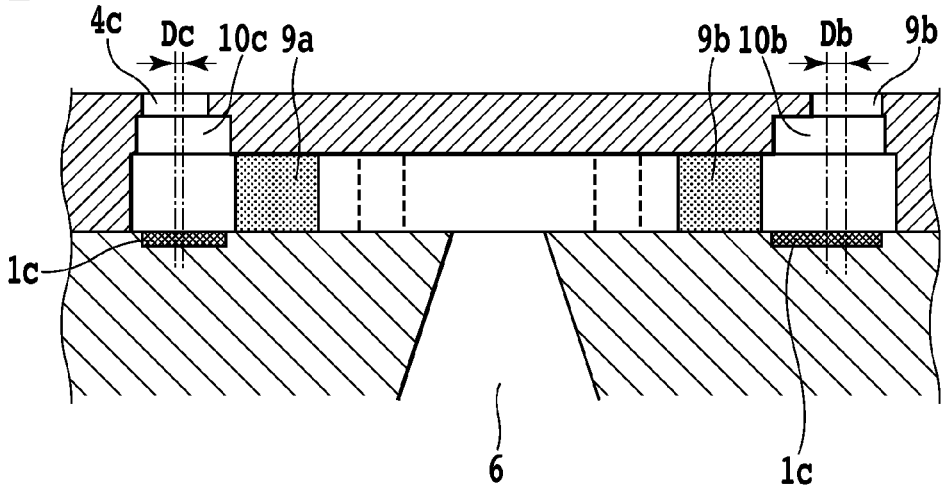
Figure 8C:
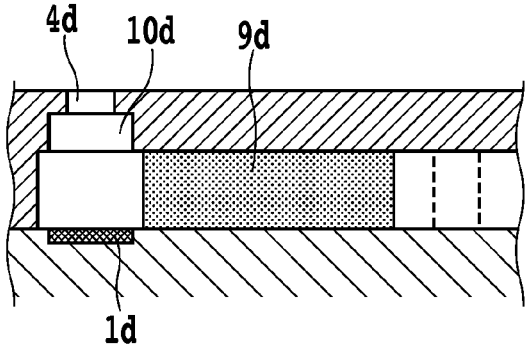

FIG. 8A to FIG. 8C are diagrams each illustrating the structure of the ejection ports of the inkjet print head according to the third embodiment. FIG. 8A is a plan view showing some of the plurality of ejection ports when viewed from the direction at right angles to a substrate of the inkjet print head.

FIG. 8B is a sectional view taken along the VIIIB-VIIIB line in FIG. 8A. FIG. 8C is a sectional view taken along the VIIIC-VIIIC line in FIG. 8A.

In the print head of the third embodiment, as in the case of the second embodiment, the ejection ports connected to the ink paths having different flow resistances are arranged on the right and left sides. Each of the ink paths 9*b*, 9*c*, 9*d* corresponding to these ejection ports has one end linked to a pressure chamber 11 and the other end linked to the ink supply port 6 through an ejection-port filter 5. The ejection ports 4*c* and 4*d* are arranged in a zigzag relationship. The size of each of the ejection ports 4*c* and 4*d* is the same as that in the second embodiment.

In the third embodiment, the center of each of the ejection ports 4*b*, 4*c*, 4*d* is not in offset relationship with the center of the corresponding heater. In this structure the amount of clearance with respect to the ejection port 4 is reduced. The operation and effect of the structure are excellent when variations are minimized from the viewpoint of the manufacture process.

Fourth Embodiment

In the second and the third embodiments, the ejection ports 4*c* and 4*d* arranged on one side of the ink supply port 6 are alternated in position in a zigzag form. However, the present invention is not limited to this arrangement. The ejection ports arranged on both sides of the ink supply port 6 may be alternated in position in a zigzag form.

Figure 9A:
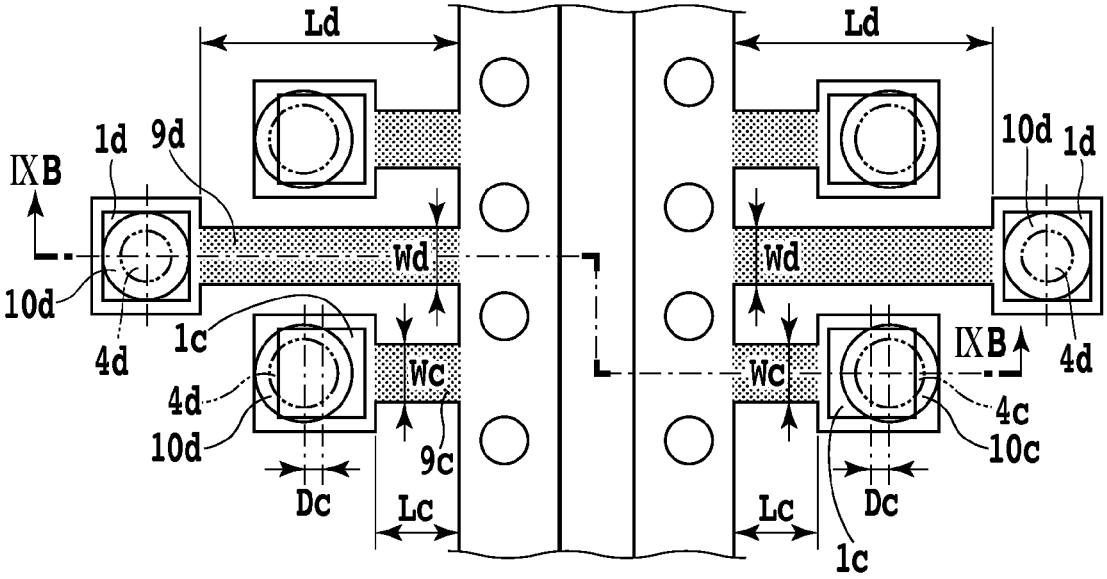
FIG. 9A and FIG. 9B are diagrams each illustrating the structure of ejection ports of an inkjet print head according to a fourth embodiment of the present invention.
Figure 9B:
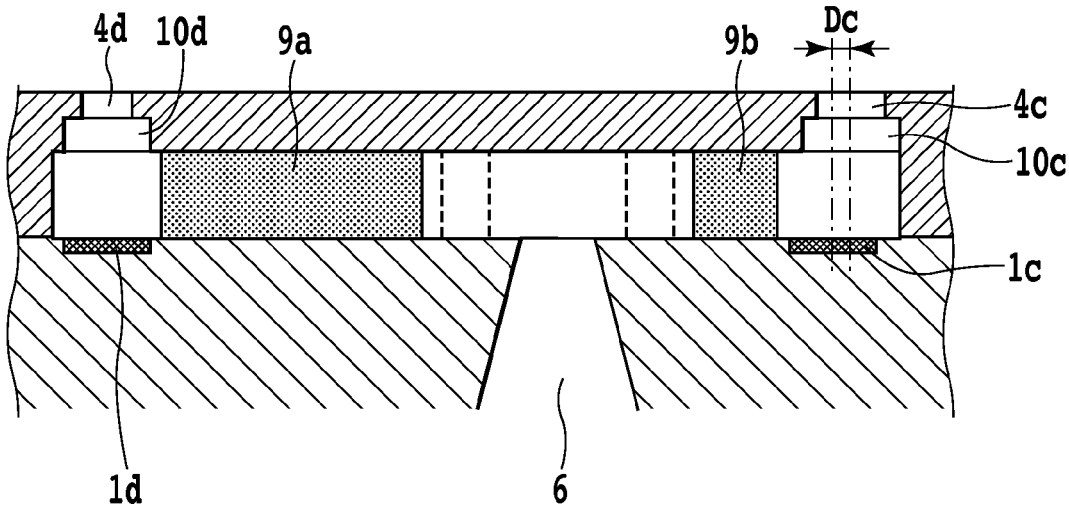
Figure 10:
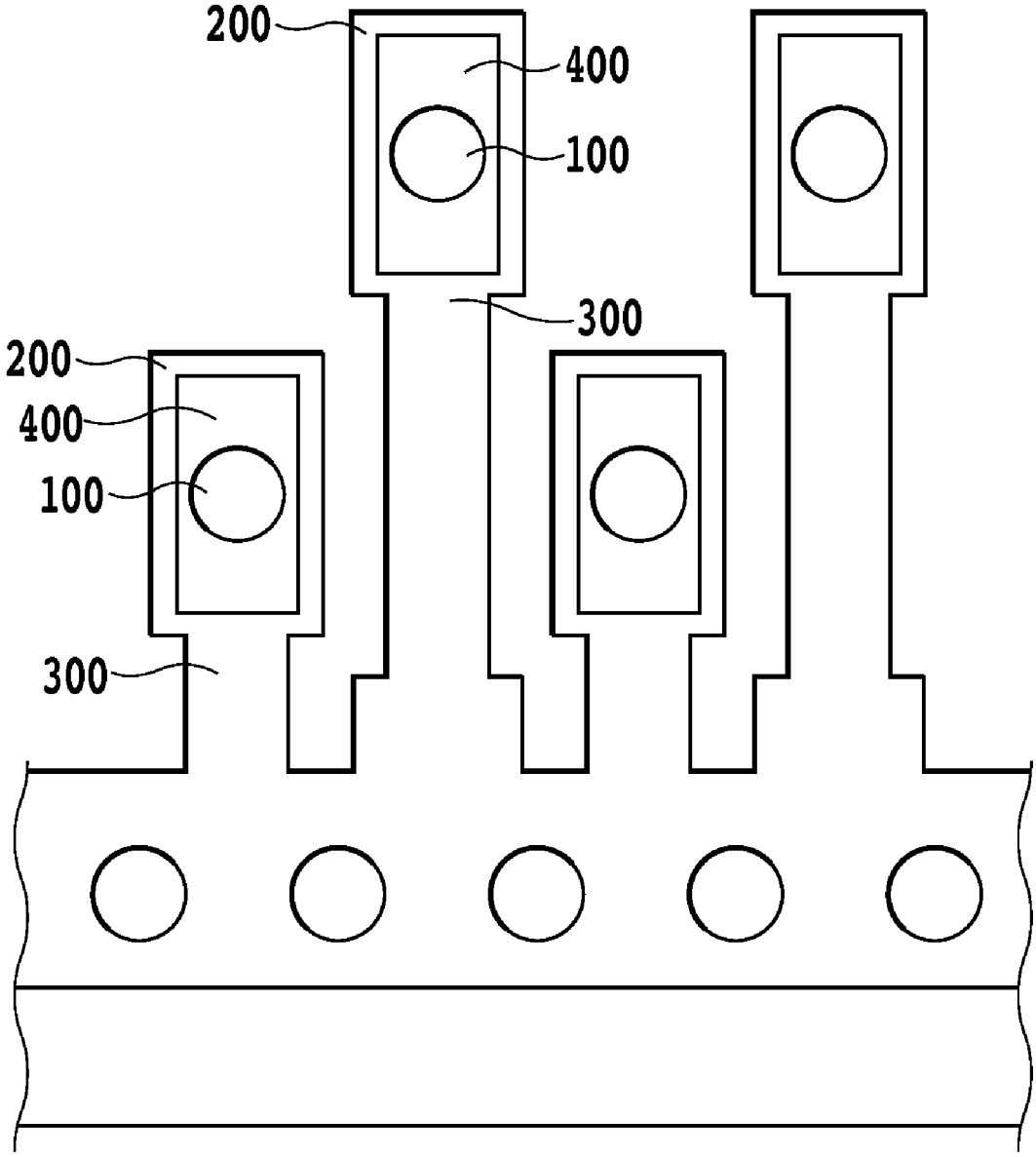
FIG. 10 is a schematic diagram illustrating a conventional print head.

FIG. 9A and FIG. 9B are diagrams each illustrating the structure of the ejection ports of the inkjet print head according to the fourth embodiment. FIG. 9A is a plan view showing some of the plurality of ejection ports when viewed from the direction at right angles to a substrate of the inkjet print head. FIG. 9B is a sectional view taken along the IXB-IXB line in FIG. 9A.

Employing this structure allows small droplets to impinge at high speeds.

(Others)

The heater described in the foregoing embodiments is shaped in a square form, but the present invention is not limited to such a heater. The heater may have a rectangular shape or maybe provided in plural. The ejection port described in the foregoing embodiments is shaped in a circle form, but the present invention is not limited to such a form. The ejection port may be shaped in an ellipse form or a rectangular form.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-320143, filed Dec. 11, 2007, which is hereby incorporated by reference herein in its entirety.

What is claimed is:

1. An inkjet print head which ejects ink supplied from an ink supply port through a plurality of ejection ports respectively connecting to ink paths having different flow resistances by using energy generated by a plurality of electrothermal transducer elements respectively corresponding to the plurality of the ejection ports, wherein each of the plurality of the ejection ports connected to the ink paths having a low ink flow resistance is arranged so that a distance from the center of each of the plurality of the ejection ports in a direction away from the ink supply port to the center of the corresponding electrothermal transducer element is greater than that of each of the plurality of the ejection ports connected to the ink paths having a high ink flow resistance and corresponding electrothermal transducer elements, and when the flow resistance of the ink path is 0.03 ($P \cdot Pa \cdot s/m^3$) or higher and less than 0.2 ($P \cdot Pa \cdot s/m^3$), the distance between the center of the ejection port and the center of the corresponding electrothermal transducer element ranges from zero to 3 μm.

2. An inkjet print head according to claim 1, wherein the ejection ports supplied with the ink from the ink paths having the high ink flow resistance and the ejection ports supplied with the ink from the ink paths having the low flow resistance are arranged in a zigzag form.

3. An inkjet print head according to claim 1, wherein each of the ejection ports supplied with the ink from the ink paths having the high ink flow resistance and each of the ejection ports supplied with the ink from the ink paths having the low flow resistance have different diameters.

4. An inkjet print head which ejects ink supplied from an ink supply port through a plurality of ejection ports respectively connecting to ink paths having different flow resistances by using energy generated by a plurality of electrothermal transducer elements respectively corresponding to the plurality of the ejection ports, wherein each of the plurality of the ejection ports connected to the ink paths having a low ink flow resistance is arranged so that a distance from the center of each of the plurality of the ejection ports in a direction away from the ink supply port to the center of the corresponding electrothermal transducer element is greater than that of each of the plurality of the ejection ports connected to the ink paths having a high ink flow resistance and corresponding electrothermal transducer elements, and when the flow resistance of the ink path is 0.02 ($P \cdot Pa \cdot s/m^3$) or higher and less than 0.06 ($P \cdot Pa \cdot s/m^3$), the distance between the center of the ejection port and the center of the corresponding electrothermal transducer element ranges from 3 μm to 6 μm.

5. An inkjet print head according to claim 4, wherein the ejection ports supplied with the ink from the ink paths having the high ink flow resistance and the ejection ports supplied with the ink from the ink paths having the low flow resistance are arranged in a zigzag form.

6. An inkjet print head according to claim 4, wherein each of the ejection ports supplied with the ink from the ink paths having the high ink flow resistance and each of the ejection ports supplied with the ink from the ink paths having the low flow resistance have different diameters.

* * * * *